US006908211B1

(12) United States Patent
Harper

(10) Patent No.: US 6,908,211 B1
(45) Date of Patent: Jun. 21, 2005

(54) MAGNIFIED LIGHTING DEVICE

(76) Inventor: Steve A. Harper, 6099 Rowland Rd., Valdosta, GA (US) 31601

( * ) Notice: Subject to any disclaimer, the term of this patent is extended or adjusted under 35 U.S.C. 154(b) by 21 days.

(21) Appl. No.: 10/617,981

(22) Filed: Jul. 10, 2003

(51) Int. Cl.[7] ..... F21L 4/04
(52) U.S. Cl. ..... 362/187; 362/118; 362/285
(58) Field of Search ..... 362/167, 202, 362/205, 118, 114, 196, 174, 178, 312, 313, 362/344, 187, 194, 195, 16, 104, 177, 285

(56) References Cited

U.S. PATENT DOCUMENTS

| | | | | |
|---|---|---|---|---|
| 4,013,915 | A | 3/1977 | Dufft | 313/499 |
| 5,255,171 | A | 10/1993 | Clark | 362/231 |
| 5,349,509 | A * | 9/1994 | Klug | 362/362 |
| 5,595,435 | A | 1/1997 | Palmer et al. | 362/109 |
| 5,997,155 | A | 12/1999 | Ducharme | 362/298 |
| 6,190,020 | B1 | 2/2001 | Hartley | 362/184 |
| 6,220,719 | B1 * | 4/2001 | Vetorino et al. | 362/192 |
| 6,272,269 | B1 | 8/2001 | Naum | 385/43 |
| 6,483,651 | B1 | 11/2002 | Maurer | 359/819 |
| 6,485,160 | B1 | 11/2002 | Sommers | 362/184 |
| 6,502,952 | B1 | 1/2003 | Hartley | 362/184 |

OTHER PUBLICATIONS

The Brinkman Corporation, Dallas, TX Price Schedule ( 2 pages), Aug. 1, 2002.
Favour Light Enterprises, Ltd. Hong Kong Catalogue (2 pages).

* cited by examiner

*Primary Examiner*—Sandra O'Shea
*Assistant Examiner*—Guiyoung Lee
(74) *Attorney, Agent, or Firm*—McNair Law Firm, P.A.

(57) ABSTRACT

An adapter for providing a concentrated beam of light over an extended distance for a flashlight. The flashlight includes a penlight with an LED light source. The adapter includes a light collecting and magnifying barrel having a reflective inner surface and a magnifying lens and is secured with the end of the penlight encasing the LED. Light rays emitted from the LED are concentrated and reflected through the lens in the form of a condensed beam of light.

20 Claims, 1 Drawing Sheet

MAGNIFIED LIGHTING DEVICE

BACKGROUND OF THE INVENTION

The instant invention is directed to a flashlight illuminator which employs an LED light source in combination with a light ray assimilating and magnifying adapter or barrel which acts to accumulate and project the light emitted by the LED in a concentrated light beam over extended distances.

Traditional incandescent flashlights all have the ability to produce and project a confined light beam over a great distance while maintaining high intensity. The traditional flashlights use light bulbs and power sources i.e., batteries which have a limited life expectancy.

On the other hand, flashlights using Light Emitting Diodes (LED's) operate with a life expectancy which is typically a hundred fold greater than the incandescent products. The LED devices all have the same limitations i.e., a lack of light projection or light projection over limited distances and light projection of limited intensity.

There have been attempts to improve light projection and intensity of LED flashlights by using a concave reflecting dish, similar to that used in incandescent flashlights. These dishes were found to provide a more uniform light beam, however, it is highly defused and dim.

Accordingly, the instant invention has for its primary object to provide an adapter for use with an LED light source which acts to amplify, magnify and project the light produced by the light emitting diode.

Another object of the invention is the provision a flashlight with an LED light source which projects a light beam a distance substantially equivalent to that of an ordinary flashlight.

Another object of the invention is a penlight adapter capable of concentrating and magnifying the light emitted by the penlight in the form of a compact beam.

Another object of the invention is an adapter for attachment with a penlight having an LED light source which is capable of concentrating, magnifying and directing the light in the form of a concentrated beam.

Another object of the invention is the provision of an inexpensive adapter for use with LED lighting units.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
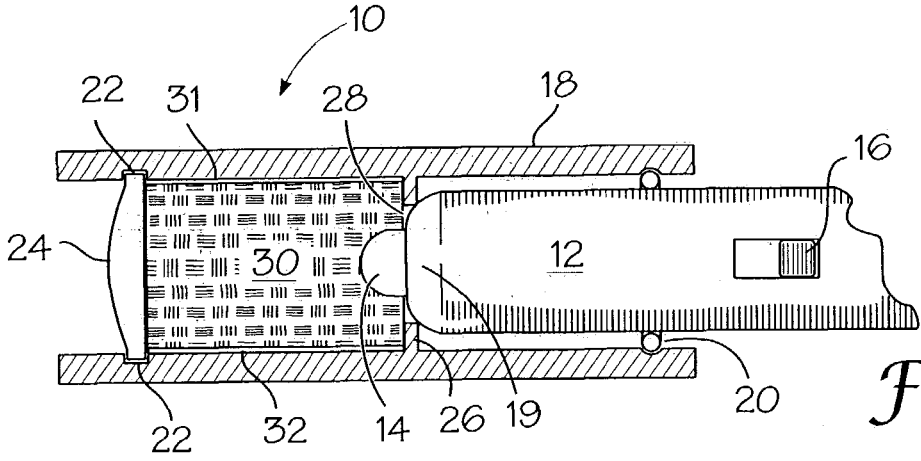
FIG. 1 is a cutaway side view of the adapter in position with a penlight.

Referring now to the drawings, the invention will now be described in more detail.

As can best be seen in FIG. 1, the adapter 10 is shown connected with a penlight 12 which is of the type which uses LED light source 14. Penlight 12 comprises a casing or body portion which carries a usual power supply. An on/off switch 16 is provided to direct power to the LED and to interrupt the power to the LED as desired. While a penlight is shown, it is noted that the adapter concept of the invention is equally usable with other types of LED flashlight illuminators.

Adapter or barrel 10 comprises an elongate tube or cylindrical encasement 18 preferably formed of plastic and formed to a length of about 1.5 to 3 inches with an inner diameter sufficient to receive forward end 19 of penlight 12. Tube 18 carries adjacent one end at least one "O" ring 20 for engaging with the outer surface of the penlight for securing and maintaining the adapter in position on the penlight. It is noted any other known securing or retaining arrangement may be substituted for "O" ring 20. Adjacent the opposite end and formed in the inner surface of adapter 10 is groove 22 which is about 0.03 inches in depth. Groove 22 is adapted to receive and secure magnifying lens 24 in position within the bore of tube 18. Between groove 22 and "O" ring 20, a raised ring 26 is formed about the inner surface of tube 18. Ring 26, along with lens 24 and the inner wall 31 of tube 18 define a substantially cylindrical cavity 30. The inner wall 31 of tube 18 is covered or lined with a reflecting member 32 which extends from ring 26 to lens 24.

Reflector 32 may be a separate piece formed of metal, plastic or paper with a glossy reflective inner surface or it may simply be a coating applied to inner wall 31. It is preferred that the reflecting surface be white although other colors or a mirror surface could be used.

Inner opening 28 of ring 26 is designed to engage and position the forward end of penlight 12 and more particularly, LED 14 in fixed position relative to lens 24. This is because the size of cavity 30 is critical.

It has been found to be most desirable that the diameter of cavity 30 be within a range of 0.375 to 1.25 inches and that the cavity length be 0.749 to 0.751 inches. Also, it has been found that lens 24 be a plano-convex lens with a diameter just slightly larger than the diameter of cavity 30 and a focal length of between 0.50 to 1.5 inches is most desirable. Further, it is preferred that the convex side of lens 24 have a radius of between 0.361 and 1.765 inches. Preferably, the lens is clear acrylic.

As earlier noted, the length of cavity 30, which defines the focal length of the adapter, is critical. For that reason, it is preferred that tube 18 be formed as a single unit. Ring 26 along with "O" ring 20 act to secure the penlight and more particularly LED 14 in fixed position relative to reflector 32 and lens 24.

Figure 3:
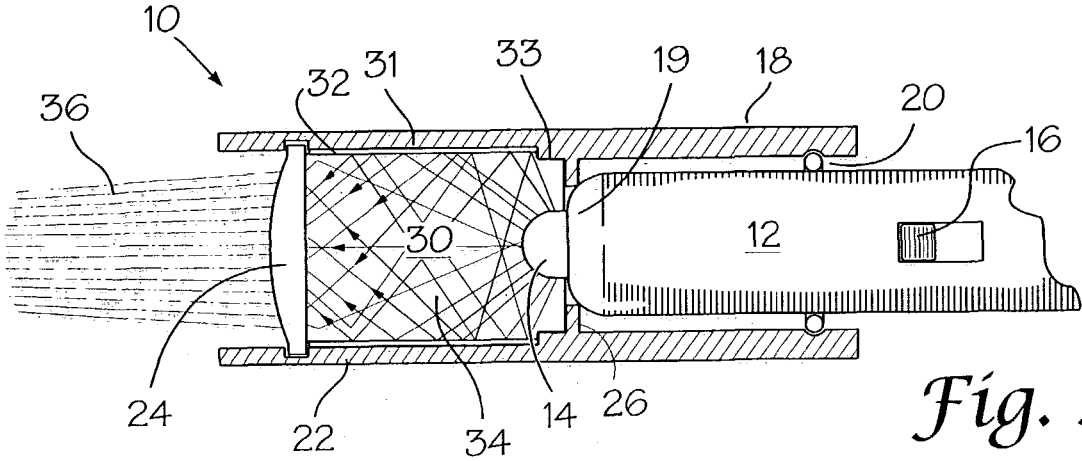
FIG. 3 is a cutaway side view of the penlight with adapter showing light beams paths through the chamber and magnifying glass of the adapter.

In operation, penlight 12 is activated by switch 16 causing LED 14 to emit light. As best shown in FIG. 3, the light rays 34 emerging from LED 14 are defused in all directions. The light rays when engaging reflector 32 are redirected and collected into lens 24. Lens 24 then acts to magnify the collected light rays delivering a condensed light beam 36 over a distance more than 10 times the normal projection length of a LED penlight and with an increase in brightness of at least 25%. It is preferred that the beam diameter be controlled to have a diameter of no more than 12 inches at a distance of 8 feet from lens 24. The adapter is capable of controlling the beam diameter to be between 2 to 120 inches at a distance of 150 feet. The beam diameter selected is dependent upon the intended use.

It is noted that any of the known LED chips may be used with adapter 10 with similar results.

Turning now to FIG. 3, adapter 10 is shown substantially as described in FIG. 1 with the exception being the structure the bore forming cavity 30. In the arrangement shown in FIG. 3, inner wall 31 is formed with a slight step down 33 adjacent inner ring 26. Step down 33 is very slight reducing the diameter of cavity 30 by between 0.75 and 0.25 inches. Reflector 32 is again arranged over the entire inner wall 31. Primarily, the purpose of step down 33 is to provide for a lens with a slightly larger diameter which is sometimes desirable.

Figure 2:
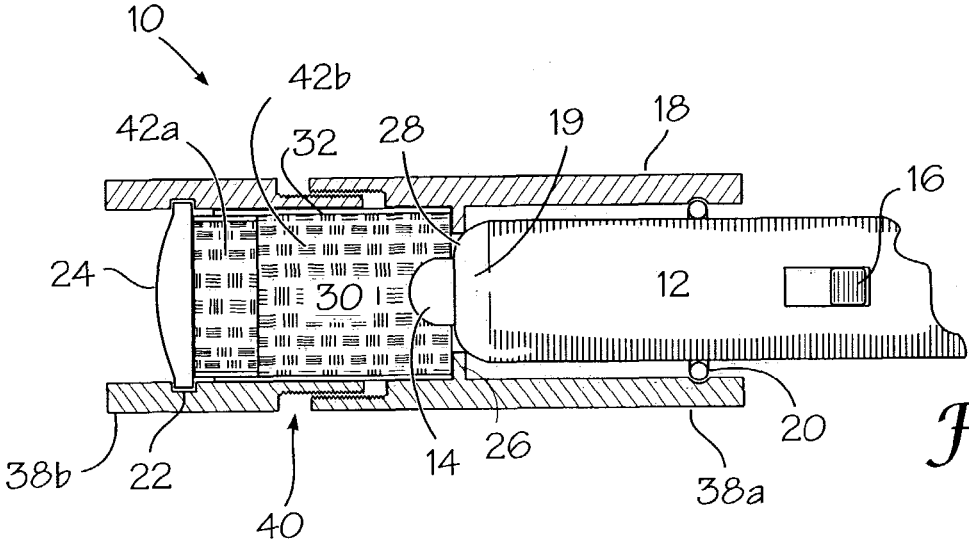
FIG. 2 is a cutaway side view of a variation of the arrangement shown in FIG. 1.

Turning now to FIG. 2 adapter 10 is shown with tube 18 formed as two interconnected members 38*a* and 38*b* interconnected with a threaded connection 40 which allows for longitudinal adjustment of cavity 30 by simply turning outer member 38*b* in the desired direction.

Again like elements are identified with the same numerals throughout to include lens 24, LED 14 and penlight 12. Reflector 32 may comprise overlapping pieces 42*a*, 42*b* which completely cover the inner surface of tube 18 and yet have the capability of slight longitudinal movement to accommodate axial adjustment of the cavity. It is intended that axial adjustment be limited to between 0.361 and 1.765 inches.

While a preferred embodiment of the invention has been described using specific terms, such description is for illustrative purposes only, and it is to be understood that changes and variations may be made without departing from the spirit or scope of the following claims.

What is claimed is:

1. A flashlight illuminator for providing a concentrated light beam comprising:

an elongate body including a power source;

an on/off switch;

an LED attached to one end of said body and engaged with said power source;

a light collecting and magnifying barrel attached at a first end to said one end of said body and encasing said LED;

said barrel carrying at a second end a lens forming a cavity between said lens and said LED;

a reflector within said cavity engaged about an inner surface of said barrel and extending between said LED and said lens wherein:

light rays emitted from said LED are collected and reflected by said reflector on to said lens, said lens magnifying and directing said collected light rays along an elongated axial path in a condensed concentrated beam pattern having a diameter of between 2 inches and 120 inches at a distance of up to 150 feet.

2. The flashlight illuminator of claim 1 wherein said lens is a plano-convex lens.

3. The flashlight illuminator of claim 2 wherein said convex side of said lens is located outside said cavity and has a radius of curvature of between 0.360 and 1.765 inches.

4. The flashlight illuminator of claim 1 wherein said cavity is between 0.5 and 1.5 inches in length.

5. The flashlight illuminator of claim 4 wherein said cavity length is fixed.

6. The flashlight illuminator of claim 1 wherein said cavity length is adjustable.

7. The flashlight illuminator of claim 1 wherein said reflector comprises a resilient sleeve which resiliently engages against said inner surface of said barrel.

8. The flashlight illuminator of claim 1 including a raised ring extending inwardly from an inner surface of said barrel adapted to fit over said LED and engage with said first end to precisely position said lens relative to said LED.

9. The flashlight illuminator of claim 1 wherein said barrel is stepped along its length.

10. The flashlight illuminator of claim 9 wherein said step is about 0.25 inches in height.

11. The flashlight illuminator of claim 9 wherein the diameter of said barrel is greater at said second end.

12. The flashlight illuminator of claim 1 wherein said first end of said barrel is pressure fit into engagement with said body.

13. The flashlight illuminator of claim 1 wherein said lens projects a concentrated beam pattern of light over a distance at least 10 times the distance of beam projection of said LED absent said barrel, said lens and said reflector.

14. The flashlight illuminator of claim 1 wherein said body comprises a penlight.

15. A flashlight illuminator for providing a concentrated light beam comprising:

an elongate body including a power source;

an on/off switch;

an LED attached to one end of said body and engaged with said power source;

a light collecting and magnifying barrel attached at a first end to said one end of said body and encasing said LED;

said barrel carrying at a second end a piano-convex lens forming a cavity within said barrel between said lens and said LED with said convex side of said lens being outward of said cavity;

said lens having a focal length of between 0.5 and 1.5 inches;

a reflector within said cavity covering an inner surface of said barrel and extending between said LED and said lens wherein:

light rays emitted from said LED are collected and reflected by said reflector on to said lens, said lens magnifying, directing said collected light rays along said focal length in a condensed concentrated beam pattern of light.

16. An adapter for a flashlight having a casing and an LED light source at one end comprising:

a tubular housing having an inner surface and carrying at one end a magnifying lens and at a second end a raised ring extending inwardly from said inner surface and a securing portion, said ring and said lens defining a focal length;

a reflective surface arranged between said magnifying lens and said ring, said reflective surface covering said inner surface of said housing over said focal length;

said securing portion being formed outwardly of said raised ring at said second end, whereby, said securing portion is adapted to engage over said casing of said flashlight with said raised ring contacting said one end positioning said LED light source to extend through said raised ring so that light rays emitted from said LED are deflected and concentrated over said focal length within said tubular housing, and projected through said lens in the form of a condensed light beam.

17. The adapter according to claim 16 wherein said tubular housing comprises a first and second portion interconnected with said housing between said lens and said raised ring, said first and second portions being axially adjustable.

18. The adapter according to claim 16 wherein said lens is a plano-convex lens with the convex side surface directed outwardly.

19. The adapter according to claim 18 wherein said convex side of said lens has a radius of curvature of between 0.360 and 1.765 inches.

20. The adapter according to claim 16 wherein said focal length is between 0.5 and 1.5 inches in length.

* * * * *